US005144935A

United States Patent [19]

Taruya et al.

[11] Patent Number: 5,144,935

[45] Date of Patent: Sep. 8, 1992

[54] IGNITION COIL UNIT FOR AN INTERNAL COMBUSTION ENGINE

[75] Inventors: Masaaki Taruya; Mitsuru Koiwa, both of Himeji, Japan

[73] Assignee: Mitsubishi Denki Kabushiki Kaisha, Tokyo, Japan

[21] Appl. No.: 767,752

[22] Filed: Sep. 30, 1991

[30] Foreign Application Priority Data

Oct. 3, 1990 [JP] Japan ..... 2-103639[U]

[51] Int. Cl.[5] ..... F02P 3/055

[52] U.S. Cl. ..... 123/633; 123/634

[58] Field of Search ..... 123/634, 635, 647, 633

[56] References Cited

U.S. PATENT DOCUMENTS

| | | | |
|---|---|---|---|
| 3,048,704 | 8/1962 | Estes | 123/633 |
| 3,304,926 | 2/1967 | Maiden et al. | 123/647 |
| 4,841,944 | 6/1989 | Maeda et al. | 123/634 |

FOREIGN PATENT DOCUMENTS

| | | |
|---|---|---|
| 61-1709 | 1/1986 | Japan . |
| 61-20774 | 6/1986 | Japan . |
| 61-21581 | 6/1986 | Japan . |

*Primary Examiner*—Andrew M. Dolinar

*Attorney, Agent, or Firm*—Sughrue, Mion, Zinn, Macpeak and Seas

[57] ABSTRACT

An ignition coil unit comprising an open-circuit magnetic iron core (6) having a longitudinal axis C, a primary coil (2) wound around the open-circuit magnetic core (6), a secondary coil (7) wound around the primary coil (2) and an outer magnetic iron core (10) disposed around the secondary coil (7). A power switching element (9*a*) for switching a primary current flowing through the primary coil (2) is disposed on the longitudinal axis of the open-circuit magnetic iron core (6) at its one end. A magnetic shield (20,21) is disposed between the open-circuit magnetic iron core (6) and the power switching element (9*a*) for protecting the latter against leakage magnetic fluxes from the open-circuit magnetic iron core (6). The magnetic shield may be a magnetic shunt plate (20) for leading the leakage flux into the outer magnetic iron core (10) or a magnetic shield case (21) surrounding the power switching element (9*a*).

3 Claims, 4 Drawing Sheets

IGNITION COIL UNIT FOR AN INTERNAL COMBUSTION ENGINE

BACKGROUND OF THE INVENTION

This invention relates to an ignition coil unit for an internal combustion engine and, more particularly, to an ignition coil unit in which an ignition coil and a power switch for controlling a primary current through the ignition coil are integrally combined into a unit.

FIG. 3 is an electrical circuit diagram of a known ignition coil unit for an internal combustion engine. The ignition coil unit comprises an ignition coil A having a primary coil 2 and a secondary coil 7, and a power switch circuit B having a plurality of electric and electronic circuit components. In FIG. 3, it is also seen that an electric source C and an ignition signal control circuit D are connected to the ignition coil unit.

The power switch circuit B comprises a power transistor 1 for switching a primary current flowing through the primary coil 2 of the ignition coil A, a current limiting circuit 4 and a current detecting circuit 3 for detecting a potential difference generated by the primary current and for transmitting a primary current control signal to the current limiting circuit 4.

FIG. 4 is a sectional side view of a conventional ignition coil unit in which the ignition coil A and the power switch circuit B are integrally combined. In FIG. 4, reference numeral 5 designates a casing, 6 is a cylindrical open-circuit magnetic iron core concentrically disposed within the casing 5, 7 is a secondary coil wound on the outer circumference of a primary coil 2 which is wound around the open-circuit magnetic iron core 6, 8 is an aluminum heat dissipating plate mounted on the longitudinal axis of the open-circuit magnetic iron core 6, and 9 is a resin-molded IC package bonded to the heat dissipating plate 8. The IC package 9 is composed of the control circuit B including the power transistor 1, the current limiting circuit 4, etc. transfer-molded with a suitable resin. Reference numeral 10 is an outer magnetic iron core mounted to the inner circumferential surface of the casing 5, and 11 is an electrical connector.

In the conventional ignition coil unit as above described, the primary current of the primary coil 2 flows through the current detection circuit 3, where the current level is detected as the potential difference upon which a control signal is supplied to the current limiting circuit 4. The current limiting circuit 4 controls, in accordance with this control signal, the primary current flowing through the primary coil 2 of the ignition coil A. In response to this primary current flowing through the primary coil 2, a high voltage to be supplied to a distributor (not shown) is generated in the secondary coil 7 of the ignition coil A.

With the conventional ignition coil unit as above described, the magnetic iron cores 6 and 10 of the ignition coil A are arranged such that the magnetic flux generated by the primary and the secondary coils 2 and 7 flows between two magnetic iron cores 6 and 10 at their axial ends. Therefore, some portion of the magnetic flux emitted from the magnetic iron cores 6 and 10 reaches the resin-molded IC package 9 as a leakage magnetic flux. When this leakage magnetic flux passes through the power switching element 1 within the IC package 9, an electric current induced by the leakage flux causes an output signal from the power switching element 1 to deviate from its correct value, resulting in an erroneous operation of the power switch circuit B.

SUMMARY OF THE INVENTION

Accordingly, one object of the present invention is to provide an ignition coil unit for an internal combustion engine free from the above-discussed disadvantage of the conventional design.

Another object of the present invention is to provide an ignition coil unit for an internal combustion engine in which the power switching element is not subjected to the leakage magnetic flux from the open-circuit magnetic iron core.

Another object of the present invention is to provide an ignition coil unit in which the leakage magnetic flux from the open-circuit magnetic iron core is guided back to the outer magnetic iron core.

With the above objects in view, the ignition coil unit of the present invention comprises an open-circuit magnetic iron core having a longitudinal axis, a primary coil wound around the open-circuit magnetic core, a secondary coil wound around the primary coil and an outer magnetic iron core disposed around the secondary coil. A power switching element for switching a primary current flowing through the primary coil is disposed substantially on the longitudinal axis of the open-circuit magnetic iron core. A magnetic shield is disposed between the open-circuit magnetic iron core and the power switching element for preventing leakage magnetic fluxes from the open-circuit magnetic iron core from reaching the power switching element. The magnetic shield may be a magnetic shunt plate for leading the leakage flux into the outer magnetic iron core or a magnetic shield case completely enclosing the power switching element.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
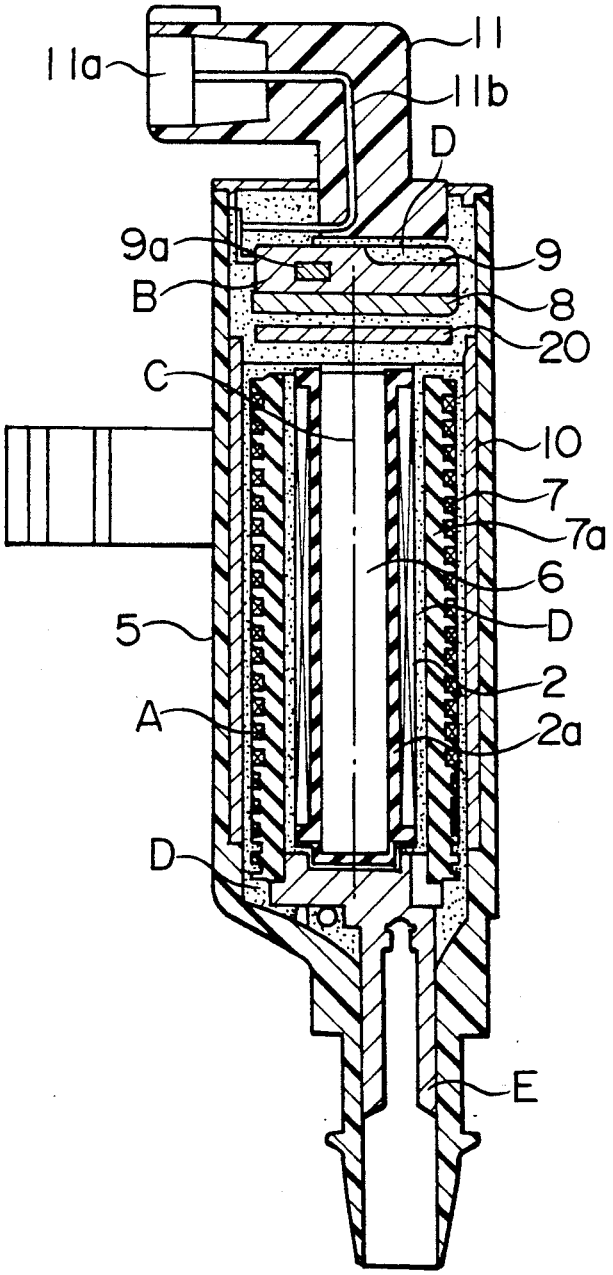
FIG. 1 is a sectional side view illustrating one embodiment of the ignition coil unit for an internal combustion engine of the present invention.
Figure 2:
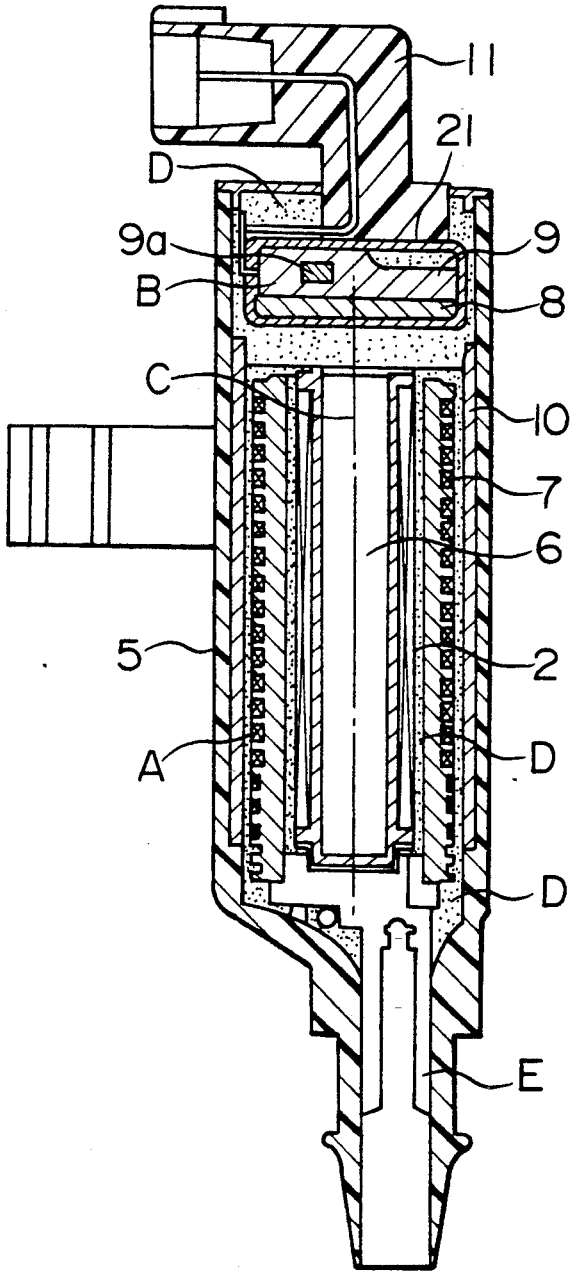
FIG. 2 is a sectional side view illustrating another embodiment of the ignition coil unit for an internal combustion engine of the present invention.
Figure 3:
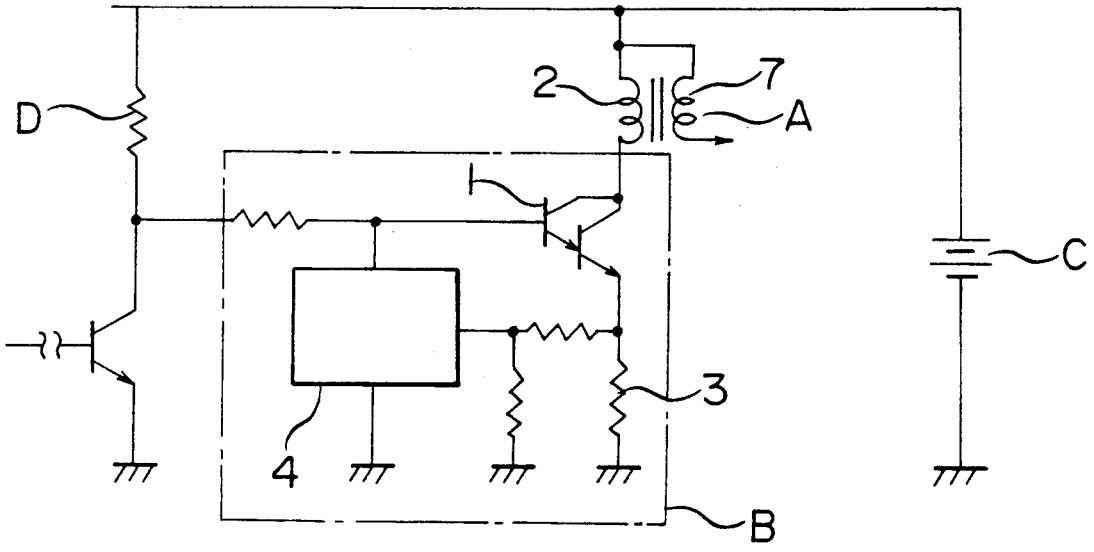
FIG. 3 PRIOR ART
FIG. 3 is a circuit diagram of a ignition coil unit to which the present invention can be applied.
Figure 4:
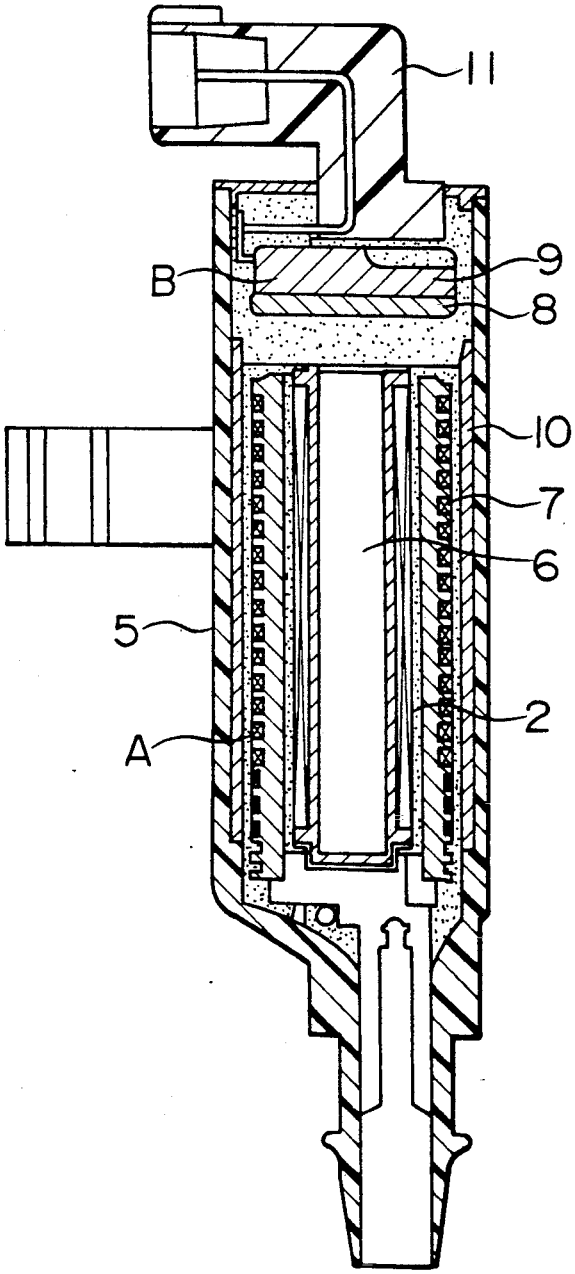
FIG. 4 PRIOR ART
FIG. 4 is a sectional side view illustrating one example of a conventional ignition coil unit.

FIG. 1 illustrates one embodiment of the ignition coil unit for an internal combustion engine of the present invention. The ignition coil unit is smaller in its basic structure to that illustrated and described in conjunction with FIGS. 1 and 2 and comprises the ignition coil A and the switching circuit B in the form of the resin-molded IC package 9 integrally sealed by a filler resin material D within the housing 5. The ignition coil A is connected to a terminal E supported by the housing 5.

More particularly, the ignition coil unit comprises the elongated open-circuit magnetic iron core 6 which is a cylindrical member made of a magnetic material having a longitudinal axis C. Concentrically disposed on the open-circuit magnetic core 6 is the primary coil 2 wound around a coil bobbin 2*a*. The secondary coil 7 wound around a bobbin 7*a* is disposed about the outer circumference of the primary coil 2 with the electrically insulating rein filler material D filed therebetween. The tubular outer magnetic iron core 10 is disposed around the secondary coil 7 with a layer of resin material D also filled the space between the outer circumference of the secondary coil 7 and the outer magnetic iron core 10. The outer circumferential surface of the outer magnetic iron core 10 is attached to the inner surface of the casing 5.

The switching circuit B in the form of the resin-molded IC package 9 which includes a power switching element 9*a* for switching a primary current flowing through the primary coil 2 is disposed substantially on the longitudinal axis C of the open-circuit magnetic iron core 6 at its open end 6*a*. The IC package 9 is attached to the heat dissipating plate 8 and connected to an terminal 11*a* through a conductor 11*b* within an electric connector 11. The IC package 9 is supported in position by the resinous filler material D filled within the interior space of the housing 5.

According to the present invention, a magnetic shield 20 is disposed between the open-circuit magnetic iron core 6 and the resin-molded IC package 9 including the power switching element 9*a* for preventing the magnetic fluxes leaked from the open-circuit magnetic iron core 6 from reaching the power switching element 9*a* of the IC package 9. The magnetic shield 20 which is made of any suitable magnetic material may be supported in position by the filer material D, or by being bonded to the heat dissipating plate 8 or by being attached to the housing 5.

In the embodiment illustrated in FIG. 1, the magnetic shield 20 is in the form of a magnetic shunt plate which functions to lead or guide the magnetic flux leaked from the open-circuit magnetic iron core 6 into the outer magnetic iron core 10 so that as little flux as possible flows through the switching element 9*a* of the IC package 9. In the embodiment illustrated in FIG. 2, the magnetic shield 20 of FIG. 1 is modified to a magnetic shield case 21 substantially completely surrounding the resin-molded IC package 9 and therefore the power switching element 9*a*. The magnetic shield case 21 is a six-sided box-shaped member completely enclosing the IC package 9 but may be a box having two sides opened.

As has been described, according to the ignition coil unit of the present invention, since the magnetic shield 20 or 21 is provided, the leakage magnetic flux from the open-circuit magnetic iron core 6 does not pass through the power switching element 9*a* of the resin-molded IC package 9, so that the output signal from the power switching element 9*a* does not deviate from its correct value, thus preventing the erroneous operation of the power switch circuit B and increasing the reliability of the operation of the ignition coil unit.

What is claimed is:

1. An ignition coil unit, comprising:

an open-circuit magnetic iron core having a longitudinal axis;

a primary coil wound around said open-circuit magnetic core;

a secondary coil wound around said primary coil;

an outer magnetic iron core disposed around said secondary coil;

a power switching element disposed substantially on said longitudinal axis of said open-circuit magnetic iron core for switching a primary current flowing through said primary coil; and a magnetic shield disposed between said open-circuit magnetic iron core and said power switching element for preventing the magnetic flux leaked from said open-circuit magnetic core from reaching said power switching element.

2. An ignition coil unit as claimed in claim 1, wherein said magnetic shield comprises a magnetic shunt plate for leading said leaked magnetic flux to said outer magnetic iron core.

3. An ignition coil unit as claimed in claim 1, wherein said magnetic shield comprises a magnetic shield case substantially completely enclosing said power switching element.

* * * * *